United States Patent [19]

Vespermann et al.

[11] Patent Number: 5,030,297

[45] Date of Patent: Jul. 9, 1991

[54] PROCESS FOR THE MANUFACTURE OF SEAMLESS PRESSURE VESSELS AND ITS NAMED PRODUCT

[75] Inventors: Dieter Vespermann, Moers-Kapellen; Bernhard Hoffmann, Hünxe; Heinz Müller, Meim/Ruhr; Ingo Von Hagen, Krefeld, all of Fed. Rep. of Germany

[73] Assignee: Mannesmann Aktiengesellschaft, Düsseldorf, Fed. Rep. of Germany

[21] Appl. No.: 429,215

[22] Filed: Oct. 30, 1989

[30] Foreign Application Priority Data

Nov. 1, 1988 [DE] Fed. Rep. of Germany ..... 3837400

[51] Int. Cl.[5] ..... C21D 8/10

[52] U.S. Cl. ..... 148/12 F; 148/12.7 R; 148/320; 148/334

[58] Field of Search ..... 148/12 F, 12.7 R, 12 R, 148/334, 320; 420/106, 110

[56] References Cited

FOREIGN PATENT DOCUMENTS 2649019 10/1979 Fed. Rep. of Germany .
58-001059 1/1983 Japan .
61-87818 5/1986 Japan ..... 148/12 F

*Primary Examiner*—Deborah Yee
*Attorney, Agent, or Firm*—Nils H. Ljungman & Associates

[57] ABSTRACT

A process for the manufacture of a seamless pressure vessel and the seamless pressure vessel produced thereby, the process including the steps of employing an aluminum-killed CrMo steel which includes by wt. %: 0.28–0.39% C; 0.15–0.40% Si; 0.45–0.90% Mn; max. 0.02% P; max. 0.005% S; 0.90–1.30% Cr; 0.15–0.35% Mo; 0.0010–0.040% Ti; 0.001–0.003% B; and 0.003–0.010% N; hot working the alumninum-killed CrMo Steel to produce the seamless pressure vessel, austenizing the seamless pressure vessel at a temperature between about 830° C. and about 880° C.; cooling the seamless pressure vessel at a cooling rate of between about 5° K/s and about 15° K/s; and tempering the seamless pressure vessel at a temperature between about 510° C. and about 660° C.

13 Claims, No Drawings

PROCESS FOR THE MANUFACTURE OF SEAMLESS PRESSURE VESSELS AND ITS NAMED PRODUCT

BACKGROUND OF THE INVENTION

1. Field of the Invention

The present invention relates to a process for the manufacture of seamless pressure vessels from a CrMo steel.

2 Description of the Prior Art

The manufacture of such pressure vessels has been part of the prior art for many years. The limit conditions to be observed in the fabrication of such vessels are contained in published technical standards and documentation, e.g., in VdTUV Material Specification 431 (Edition 03.88). Apart from the composition of the material to be used, the above-referenced Material Specification prescribes, among other things, a hardening treatment and a tempering of the finished pressure vessel. The hardening, in the context of a quenching and tempering, occurs after an annealing at 830° to 880° C. and a hold time of at least one minute per mm of wall thickness of the pressure vessel, but with the hold time being at least 15 minutes, with a subsequent quenching in oil, which has a maximum temperature of 50° C. The tempering is performed at 530° to 680° C. with a hold time of at least 2 minutes per mm of wall thickness, but with the hold time being at least 30 minutes, and with a subsequent cooling in air. The pressure vessels must exhibit at least the following essential material characteristics:

| | | |
|---|---|---|
| 0.2% proof stress | $R_p0.2$ | >755 N/mm$^2$ |
| Tensile strength | $R_m$ | = 880–1030 N/mm$^2$ |
| Elongation after fracture | $A_{2''}$ | >14% |
| Notch impact toughness | $^a$K-20° C. transverse | >25 J/cm$^2$ |

The characteristics of a particular alloy are customarily determined as an average of the measurements performed on three test pieces. The notch impact toughness may be determined using the well know Charpy V-Notch (or "CVN") Impact Test. For a pressure vessel which is 229 mm in diameter and which has a minimum wall thickness of 5.8 mm, manufactured from a customary material, i.e., 34 CrMo4, having the following analysis:

0.36% C
0.21% Si
0.68% Mn
0.014% P
0.007% S
1.03% Cr
0.24% Mo
0.0081% N which was quenched in oil after a 15 minute annealing at 850° C., which was then tempered for 30 minutes at 630° C., and which was finally cooled in air, the following material characteristics were measured:

$R_p0.2$=812 N/mm$^2$

Rm=938 N/mm$^2$ $A_{2''}$=15.6% aK-20° transverse=87 J/cm$^2$ aK-40° transverse=52 J/cm$^2$ (with brittle fractures)

The values for the 0.2% proof stress were scattered, the scatter range being 85 N/mm$^2$. The same is true for the hardness values, which were scattered over a range of 40 HB. As used herein, the terms "scatter", "scatter range" and "scatter band" (in the German language, "die Briete des Streubandes") indicate that measured values are spread over some range of deviation from an average value.

For special applications, it may be desirable to significantly increase the strength characteristics of certain particular pressure vessels, while effecting a simultaneous retention of the toughness characteristics, or to significantly increase the toughness characteristics, while effecting a simultaneous retention of the strength characteristics. The present invention is particularly well suited for such applications.

In accordance with a known manufacturing process, an improvement in the toughness can be achieved with an appropriate variation of the heat treatment, but the improvement in toughness is normally always accompanied by a significant reduction in strength, and vice-versa.

OBJECTS OF THE INVENTION

A principal object of the present invention is the provision of a process for the manufacture of pressure vessels made of a CrMo steel, wherein an increase in the strength characteristics or toughness characteristics is not accompanied by a corresponding significant deterioration of the respective other characteristic.

Another object of the present invention is the provision of a process whereby the mechanical/technological characteristics may be more uniformly maintained.

SUMMARY OF THE INVENTION

The invention includes a process for the manufacture of a seamless pressure vessel. This process comprises the steps of employing an aluminum-killed CrMo steel comprising by wt. %: 0.28–0.38% C; 0.15–0.40% Si; 0.45–0.90% Mn; max. 0.02% P: max. 0.005% S: 0.90–1.30% Cr: 0.15–0.35% Mo; 0.010–0.040% Ti; 0.001–0.003% B; and 0.003–0.010% N. Working the aluminum-killed CrMo steel produces the seamless pressure vessel and then the seamless pressure vessel is austenized at a temperature between about 830° C. and about 880° C. The seamless pressure vessel is cooled at a rate of between about 5° K./s and about 15° K./s. The tempering of the seamless pressure vessel is at a temperature between about 510° C. and about 660° C.

The invention also includes a seamless pressure vessel which is formed from an aluminum-killed CrMo steel comprising by wt. %: 0.28–0.38% C; 0.15–0.40% Si; 0.45–0.90% Mn: max. 0.02% P;

max 0 005% S; 0.90–1.30% Cr; 0.15–0.35% Mo: 0.010–0.040% Ti; 0.001–0.003% B: and 0.003–0.010% N.

DESCRIPTION OF THE PREFERRED EMBODIMENT

It is believed that the characteristics, after a quenching and tempering hardening treatment which improve strength and/or toughness characteristics, are connected with the microalloy elements Ti and B. In this context, for example, German Patent Publication Published for Opposition Purposes No. 26 49 019 discloses steels for the manufacture of seamless steel tubes which preferably have the following composition, and which are said to make possible the hardening of the tubes from the rolling heat, without significant distortion of the tubes:

0.05–0.30% C
0.01–0.40% Si
0.80–1.50% Mn as well as one or more of the following elements:

0.01–5.00% Cr
0.01–2.0% Ni
0.01–1.0% Cu
0.01–2.0% Mo
up to 0.10% Al
up to 0.50% V
up to 0.50% Ti
up to 0.50% Zr
up to 0.50% Nb
0.0003–0.0050% B with the remainder being iron and the usual impurities.

In the embodiments described in the above-identified published German application, no alloy is disclosed which is comparable to the composition according to the present invention. In general, the C-concentrations indicated therein are too low, and the concentrations of P and S are not even indicated. With regard to the present invention, it is even more important that, for the steels containing Ti and B, no Mo concentration is specified in the published German application, and the concentrations of Cr which are specified are either much too low (0.51%) or are absent altogether. This is in full accordance with current practice, in which Cr-Mo heat-treatable steels are typically always considered independently from the TiB heat-treatable steels. German Patent Publication Published for Opposition Purposes No. 26 49 019 discloses nothing about the notch impact energy. Nor can any conclusions be drawn therefrom about the values of the notch impact energy transition temperature.

Therefore, the present inventors consider it as being altogether surprising that drastic improvements in strength and toughness (e.g., notch impact energy) can be achieved, for a steel with the severely limited alloy concentrations according to the invention, with certain N-concentrations and with the addition of Ti and B alloy elements, and while complying with the requirements for the Ti/N ratio and the the heat treatment parameters indicated by the invention, as can be seen in the embodiments listed in Table I.

OPERATIVE EXAMPLES

In Table I, an example of the above-mentioned prior art has been included for purposes of comparison. All of the examples set forth relate to a pressure vessel having a diameter of 229 mm and having a minimum wall thickness of 5.8 mm. In the embodiments according to the invention, a material having the following analysis was used:

0.31% C
0 23% Si
0,72% Mn
0.017% P .
0.004% S
0.98% Cr
0.21% Mo
0.0068% N
0.031% Ti
0.0014% B

In Example 1 (according to the invention), with a slightly improved $R_{p0.2}$ value of 819 Nmm$^2$, a 55% increase in the notch impact toughness at −20° C. was achieved, as well as a 108% improvement at −40° C. It is noteworthy that the width of the scatter band of the $R_{p0.2}$ proof stress was reduced by approximately 44% and the hardness by 35%, as compared to the corresponding values according to the prior art.

Example 2 (according to the invention) aimed at an increase in strength, with a complete retention of toughness characteristics. With values for the notch impact toughness of 95 J/cm$^2$ and 68 J/cm$^2$ at −20° C. and −40° C., respectively, the improvements in toughness are even greater than in the comparative example, by approximately 9% and 31%, respectively. The elongation $A_{2''}$achieved was 13.5%, only slightly below the specified minimum value of 14%. This slight adverse effect, however, must be considered in view of the fact that the $R_{p0.2}$ proof stress was increased from 812 Nmm$^2$ to 1025 Nmm$^2$, i.e., by approximately 26%, without a decrease in toughness, which result is altogether acceptable. The width of the scatter bands of the proof stress and of the hardness were simultaneously reduced by 39% and 22% respectively.

The two embodiments of the invention set forth clearly show that significant improvements in the strength and/or toughness characteristics can be achieved on seamless pressure vessels made of CrMo steel.

Preferably, in a process for the manufacture of a seamless pressure vessel according to the present invention, an aluminum-killed CrMo steel is formed into a tubular shape (e.g., as in the production of seamless pipe or tubing), and the tubular shape is then hot worked to produce the seamless pressure vessel. The seamless pressure vessel is then austenized, cooled to room temperature, tempered and finally cooled in air, as described herein.

Processes for the manufacture of seamless steel tubing or pipe are well known in the art. For example, processes for the manufacture of seamless tubing developed by the assignee of the present invention are widely known. Additionally, processes for the production of seamless vessels are disclosed in U.S. Pat. No. 4,530,228, issued on July 23, 1985 and entitled "Apparatus For Producing Seamless Container Bodies", U.S. Pat. No. 4,157,694, issued on June 12, 1979 and entitled "Method Of Producing A TinPlated Seamless Container" and U.S. Pat. No. 4,157,693, issued on June 12, 1979 and entitled "Seamless Drawn And Ironed Container With Opening Means And Method And Apparatus For Forming The Same". Still further, a method for the production of seamless tubing is disclosed in U.S. Pat. No. 4,848,124, issued on July 18, 1989 and entitled "Making Seamless Pipes Over 200MM In Diameter", a U.S. patent assigned to the assignee of the present application.

"Aluminum-killed" steels are also well known in the art of metallurgy and are described, for example, in U.S. Pat. No. 4,591,395, issued on May 27, 1986 and entitled "Method Of Heat Treating Low Carbon Steel Strip" and U.S. Pat. No. 4,576,656, issued on March 18, 1986 and entitled "Method Of Producing Cold Rolled Steel Sheets For Deep Drawing".

Similarly, techniques for "austenizing" metals are also well known in the metallurgical field and are disclosed, for example, in U.S. Pat. No. 3,860,457, issued on Jan. 14, 1975 and entitled "A Ductile Iron And Method Of Making It" and in U.S. Pat. No. 4,666,533, issued on May 19, 1987 and entitled "Hardenable Cast Iron And The Method Of Making Cast Iron".

While in Operative Examples 1 and 2 set forth above and in the accompanying Table I, a CrMo steel was employed having specific percentages of composition (e.g., 0.31% C, 0.23% Si, etc.), the present inventors have discovered that aluminum-killed CrMo steels having compositions which fall within the following range of constituent components are preferably suitable for practice of the present invention: 0.28–0.38% C: 0.15–0.40% Si: 0.45–0.90% Mn; max. 0.02% P; max. 0.005% S; 0.90–1.30% Cr: 0.15–0.35% Mo: 0.010–0.040% Ti: 0.001–0.003% B; and 0.003–0.010% N.

In summary, one aspect of the invention resides broadly in the process for the manufacture of seamless pressure vessels by the hot working of steel tubes made of an aluminum-killed CrMo steel having the following composition (by wt. %):

0.28–0.38% C
0.15–0.40% Si
0 45–0.90% Mn
max. 0.02% P
max. 0.005% S
0.90–0.35% Cr
0 15–0.35% Mo the remainder being of iron and usual impurities, wherein the pressure vessel is hardened, following the hot working, by being austenized at 830°–880° C., then cooled to room temperature at a cooling rate of 5°–15° Kelvin/sec. (or °C./sec.), then tempered at a temperature up to 680° C. and finally cooled in air. The steel which is used has a specified N-content of 0.003–0.010%, and also contains:

0.010–0.040% Ti
0.001–0.003% B the Ti/N ratio being at least 3.4, and the tempering being performed between 510° C. and 660° C., depending on the desired strength level.

Another aspect of the invention resides broadly in the process wherein, to increase the notch impact toughness, the tempering is performed at 620° C.–660° C.

Yet another aspect of the invention resides broadly in the process wherein, to increase the strength, the tempering is performed at 510°–550° C.

All of the patents, patent applications, and publications recited herein, if any, are hereby incorporated by reference, as if set forth in their entirety herein.

The invention as described hereinabove in the context of a preferred embodiment is not to be taken as limited to all of the provided details thereof, since modifications and variations thereof may be made without departing from the spirit and scope of the invention.

TABLE I

| Characteristics | | Comparison Example (Prior Art) | Invention Example 1 | Invention Example 2 |
|---|---|---|---|---|
| Austenizing Temperature (° C.) | | 850 | 850 | 830 |
| Hold time (min.) | | 15 | 15 | 15 |
| Quenching | | Oil | Oil | Oil |
| Tempering Temperature (° C.) | | 630 | 630 | 530 |
| Hold time (min.) | | 30 | 30 | 30 |
| $R_{p0.2}$ | $N/mm^2$ | 812 | 819 | 1025 |
| $\Delta R_{p0.2}$ | $N/mm^2$ | 85 | 48 | 52 |
| $R_m$ | $N/mm^2$ | 938 | 962 | 1110 |
| $A_{2''}$ | % | 15.6 | 16.1 | 13.5 |
| $a_K$-20° C. transverse | $J/cm^2$ | 87 | 135 | 95 |
| $a_K$-40° C. transverse | $J/cm^2$ | 52 (with brittle fractures) | 108 (without brittle fractures) | 68 (with brittle fractures) |
| ΔHardness (HB) | | 40 10 | 26 | 31 |

What is claimed is:

1. A process for the manufacture of a seamless pressure vessel, said process comprising the steps of:

employing an aluminum-killed CrMo steel, said aluminum-killed CrMo steel comprising by wt. %:
0.28–0.38% C;
0.15–0.40% Si;
0.45–0.90% Mn;
max. 0.02% P;
max. 0.005% S:
90–1.30% Cr;
0.15–0.35% Mo;
0.010–0.040% Ti;
0.001–0.003% B; and
0.003–0.010% N;

working said aluminum-killed CrMo steel to produce said seamless pressure vessel;

austenizing said seamless pressure vessel at a temperature between about 830° C. and about 880° C.;

cooling said seamless pressure vessel at a cooling rate of between about 5 and about 15 degrees Kelvin per second: and tempering said seamless pressure vessel at a temperature between about 510° C. and about 660° C.

2. The process according to claim 1, wherein said aluminum-killed CrMo steel has a Ti content to N content ratio of at least 3.4, said Ti content and N content being determined by wt. %.

3. The process according to claim 1, wherein said step of working said aluminum-killed CrMo steel comprises hot working of said aluminum-killed CrMo steel.

4. The process according to claim 2, wherein said step of working said aluminum-killed CrMo steel comprises working of said aluminum-killed CrMo steel.

5. The process according to claim 3, said process further comprising the additional step of forming said aluminum-killed CrMo steel into a tubular shape prior to said step of hot working said aluminum-killed CrMo steel to produce said seamless pressure vessel.

6. The process according to claim 1, said process further comprising the additional step of cooling said seamless pressure vessel in air following said step of tempering said seamless pressure vessel at a temperature between about 510° C. and about 660° C.

7. The process according to claim 3, said process further comprising the additional step of cooling said seamless pressure vessel in air following said step of tempering said seamless pressure vessel at a temperature between about 510° C. and about 660° C.

8. The process according to claim 1, wherein said step of tempering said seamless pressure vessel is carried out at a temperature of between about 620° C. and 660° C., whereby the notch impact toughness of said aluminum-killed CrMo steel is relatively increased 9. The process according to claim 3, wherein said step of tempering said seamless pressure vessel is carried out at a temperature of between about 620° C. and 660° C., whereby the notch impact toughness of said aluminum-killed CrMo steel is relatively increased 10. The process according to claim 1, wherein said step of tempering said seamless pressure vessel is carried out at a temperature of between about 510° C. and about 550° C., whereby the strength of said aluminum-killed CrMo steel is relatively increased.

11. The process according to claim 3, wherein said step of tempering said seamless pressure vessel is carried out at a temperature of between about 510° C. and about 550° C., whereby the strength of said aluminum-killed CrMo steel is relatively increased.

12. A seamless pressure vessel, said seamless pressure vessel being formed from an aluminum-killed CrMo steel, said aluminum-killed CrMo steel comprising by wt. %:

0.28–0.38% C;
0.15–0.40% Si;
0.45–0.90% Mn;
max. 0.02% P;
max. 0.005% S;
0.90–1.30% Cr:
0.15–0.35% Mo;
0.010–0.040% Ti;
0.001–0.003% B; and
0.003–0.010% N;

13. The seamless pressure vessel according to claim 1, wherein said aluminum-killed CrMo steel has a Ti content to N content ratio of at least 3.4, said Ti content and N content bein determined by wt. %.

* * * * *

UNITED STATES PATENT AND TRADEMARK OFFICE

CERTIFICATE OF CORRECTION

PATENT NO. : 5,030,297

DATED : July 9, 1991

INVENTOR(S) : Dieter VESPERMANN, et al.

It is certified that error appears in the above-identified patent and that said Letters Patent is hereby corrected as shown below:

On the title page, Item [75]: in the Inventor's section indicated by the INID code [75], on line 3, delete "Meim/Ruhr" and insert --Mülheim/Ruhr--.

On the face of the patent, under the Abstract section indicated by the INID code [57], on line 5, delete "0.28-0.39%" and insert --0.28-0.38%--.

On the face of the patent, under the Abstract section indicated by the INID code [57], on line 7, after 'Mo;', delete "0.0010-0.040%" and insert --0.010-0.040%--.

On the face of the patent, under the Abstract section indicated by the INID code [57], on line 8, after 'the', delete "alumninum-killed" and insert --aluminum-killed--.

On the face of the patent, under the Abstract section indicated by the INID code [57], on line 9, after 'CrMo', delete "Steel" and insert --steel--.

In column 1, line 63, delete "$R_p0.2=812$ N/mm²" and insert --$R_{p0.2}=812$ N/mm²--.

In column 2, line 43, after '0.02%', delete "P:" and insert --P;--.

UNITED STATES PATENT AND TRADEMARK OFFICE

CERTIFICATE OF CORRECTION

PATENT NO. : 5,030,297

DATED : July 9, 1991

INVENTOR(S) : Dieter VESPERMANN, et al.

It is certified that error appears in the above-identified patent and that said Letters Patent is hereby corrected as shown below:

In column 2, line 43, after '0.005%', delete "S:" and insert --S;--.

In column 2, line 56, after '0.45-0.90%', delete "Mn:" and insert --Mn;--.

In column 2, line 57, delete "max 0 005%" and insert --max. 0.005%--.

In column 2, line 57, after '0.15-0.35%', delete "Mo:" and insert --Mo;--.

In column 3, line 60, delete "0 23%" and insert --0.23%--.

In column 3, line 61, delete "0,72%" and insert --0.72%--.

In column 4, line 2, after '819', delete "Nmm²" and insert --N/mm²--.

In column 4, line 20, delete "Nmm²", both occurrences, and insert --N/mm²--, both occurrences--.

In column 5, line 30, after '0.28%-0.38%', delete "C:" and insert --C;--.

In column 5, line 31, after '0.15-0.40%', delete "Si:" and insert --Si;--.

UNITED STATES PATENT AND TRADEMARK OFFICE

CERTIFICATE OF CORRECTION

PATENT NO. : 5,030,297

DATED : July 9, 1991

INVENTOR(S) : Dieter Vespermann, et al

It is certified that error appears in the above-indentified patent and that said Letters Patent is hereby corrected as shown below:

In column 5, line 32, after '0.90-1.30%', delete "Cr:" and insert --Cr;--.

In column 5, line 32, after '0.15-0.35%', delete "Mo:" and insert --Mo;--.

In column 5, line 33, after '0.010-0.040%', delete "Ti:" and insert --Ti;--.

In column 5, line 42, delete "0 45-0.90%" and insert --0.45-0.90%--.

In column 5, line 46, delete "0 15-0.35%" and insert --0.15-0.35%--.

In column 6:

In Claim 1, line 34, after '0.005%', delete "S:" and insert --S;--.

In Claim 1, line 35, delete "90-1.30%" and insert --0.90-1.30%--.

In Claim 1, line 21, after 'per', delete "second:" and insert --second;--.

In Column 7:

In Claim 8, line 5, after 'increased', insert --.--.

In Claim 9, line 5, after 'increased', insert --.--.

UNITED STATES PATENT AND TRADEMARK OFFICE

CERTIFICATE OF CORRECTION

PATENT NO. : 5,030,297

DATED : July 9, 1991

INVENTOR(S) : Dieter VESPERMANN, et al.

It is certified that error appears in the above-identified patent and that said Letters Patent is hereby corrected as shown below:

Column 8:

In Claim 12, line 10, after '0.90-1.30%', delete "Cr:" and insert --Cr;--.

In Claim 13, line 14, after 'content', delete "bein" and insert --being--.

Signed and Sealed this

Twenty-eighth Day of December, 1993

*Attest:*

Bruce Lehman

BRUCE LEHMAN

*Attesting Officer*

*Commissioner of Patents and Trademarks*